United States Patent [19]

Daigle

[11] Patent Number: 4,618,288

[45] Date of Patent: Oct. 21, 1986

[54] RELEASABLE LOWERING AND COUPLING ASSEMBLY FOR PILE DRIVING

[75] Inventor: Verlon C. Daigle, Gray, La.

[73] Assignee: McDermott International, Inc., New Orleans, La.

[21] Appl. No.: 784,392

[22] Filed: Oct. 4, 1985

[51] Int. Cl.[4] ..... E02D 7/00

[52] U.S. Cl. ..... 405/232; 405/228; 405/231

[58] Field of Search ..... 405/232, 250, 251, 252, 405/231; 138/89; 166/83, 206, 382

[56] References Cited

U.S. PATENT DOCUMENTS

| | | | |
|---|---|---|---|
| 1,359,956 | 11/1920 | Boardman | 405/228 |
| 1,815,660 | 7/1931 | Walker | 285/315 |
| 2,794,633 | 6/1957 | Delany | 92/52 |
| 4,051,685 | 10/1977 | Jansz | 405/228 |
| 4,154,307 | 5/1979 | Gendron et al. | 405/232 |
| 4,248,271 | 2/1981 | Burgess | 138/89 |
| 4,436,452 | 3/1984 | Bodine | 405/232 |

*Primary Examiner*—Cornelius J. Husar
*Assistant Examiner*—Kristina I. Hall
*Attorney, Agent, or Firm*—Robert J. Edwards; Michael L. Hoelter

[57] ABSTRACT

A pile lowering and coupling assembly having a plurality of latching arms pivotally secured to a follower pile that latch onto an annular catch secured to the skirt pile. A bias applied to the latching arms maintains the engagement of the follower and skirt piles by continuously urging the latching against the annular catch. Once coupled, both piles are lowered to the sea bed after which the skirt pile may be driven by applying a hammer to the free end of the follower pile which usually extends above the water surface. Once driven, the skirt pile and the follower pile are separated by removing the bias applied to the latching arms thus enabling the follower pile and the lowering and coupling assembly to be retrieved from the sea depths.

8 Claims, 5 Drawing Figures

RELEASABLE LOWERING AND COUPLING ASSEMBLY FOR PILE DRIVING

FIELD OF THE INVENTION

This invention relates to pile driving and more particularly to a device for lowering and removably coupling piles together.

BACKGROUND OF THE INVENTION

In securing off-shore structures in place, it is a common practice to drive piles into the sea bed and to secure the off-shore structure to these embedded piles. Generally, such piles consist of a follower pile coupled to a skirt pile with the elevated free end of the former being hammered upon to drive the latter into place.

One procedure for driving piles into the sea bed is to weld together enough pile sections until the lower end of the pile rests on the sea floor and the upper end of the pile extends above the water surface. This upper end is then hammered upon to drive the lower end into the sea bed, however, after driving the pile, it is undesirable to leave its entire length extending above the sea floor because of the resulting stresses that will be created. Therefore, divers are normally sent down to separate and remove this extra length which is a very expensive operation.

Another procedure for pile driving involves the use of a Vetco drivable pile connector. The Vetco tool is used to temporarily connect a follower pile to a skirt pile and then lower this combination to the sea floor. A hammer is subsequently applied to the upraised follower pile for driving the skirt pile in place, however, the Vetco tool is difficult to release and retrieve once the driving is completed and on occasion it has been known to fail. Additionally, although the Vetco tool is costly, it is often more expensive to retrieve it from deep water than it is worth thus this costly tool is often abandoned on the sea floor.

Additional devices for removably coupling piles together require electricity or hydraulic pressure for operation and these requirements merely compound the already complicated process of driving piles into the sea bed.

It is thus an object of this invention to provide a lowering and coupling assembly which enables a follower pile to be easily separable from a skirt pile thereby enabling it to be retrieved after being lowered coupled to a skirt pile.

It is another object of this invention to provide a lowering and coupling assembly that does not require electricity or hydraulic pressure for operation. It is a further object of this invention to provide a pile coupler that is simple to use, rugged in design and sturdy enough to withstand constant pounding as the coupled skirt pile is driven into the sea floor. It is another object of this invention to enable the lowering and coupling assembly to be easily secured to a skirt pile resting on the sea floor.

SUMMARY

In accordance with the preferred embodiment of this invention a follower pile includes a stabbing guide which is inserted within a skirt pile thereby concentrically aligning the follower and skirt piles. A plurality of latching members are pivotally supported inside the follower pile and each latching member includes a latching end region that extends through openings in the stabbing guide to latch with an annular catch secured to the skirt pile. These latching end regions are normally biased in the non-operative or release position and when coupling is desired, this bias is overcome to enable the follower pile to latch with the skirt pile. Following the embedding of the skirt pile, the overcoming bias is removed to pivot the latching members to their release or disengage position thereby enabling the follower pile to become separated from the embedded skirt pile.

DETAILED DESCRIPTION OF THE DRAWINGS

Figure 1:
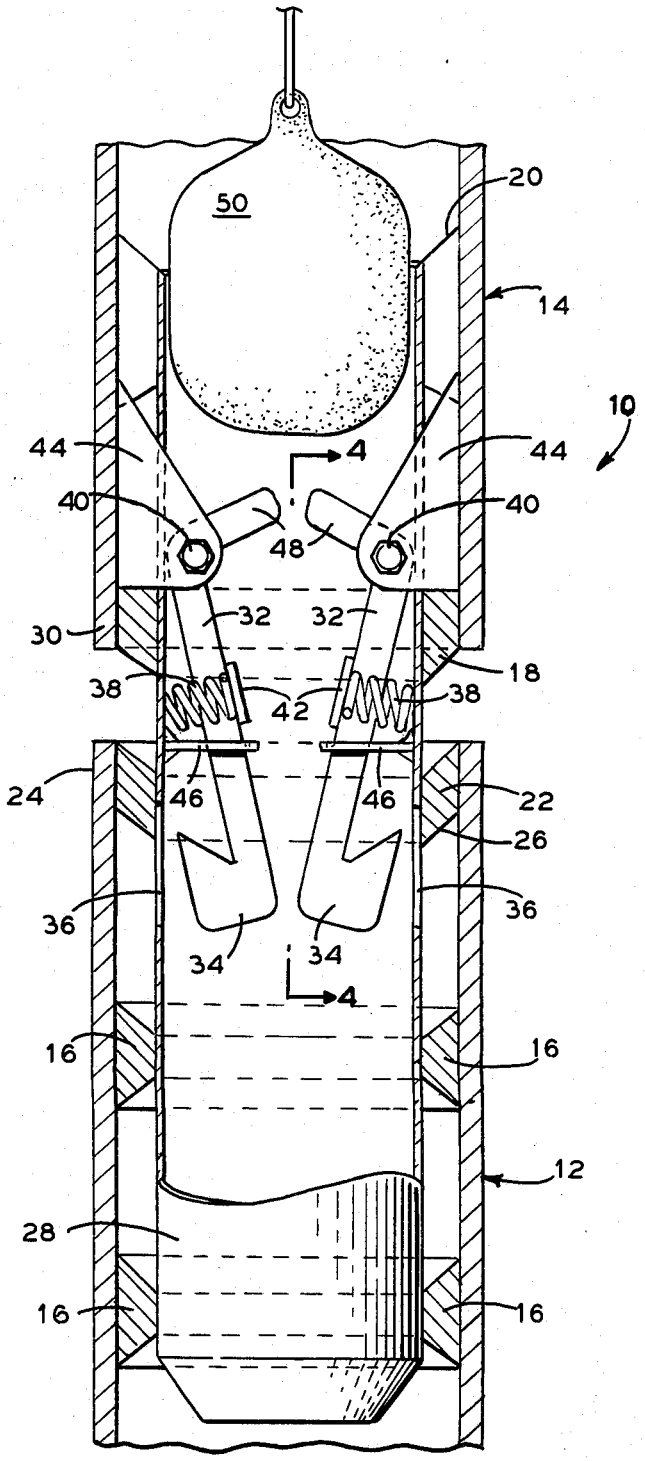
FIG. 1 is a pictorial sectional view, partially broken away, of the invention prior to latching with the skirt pile.
Figure 2:
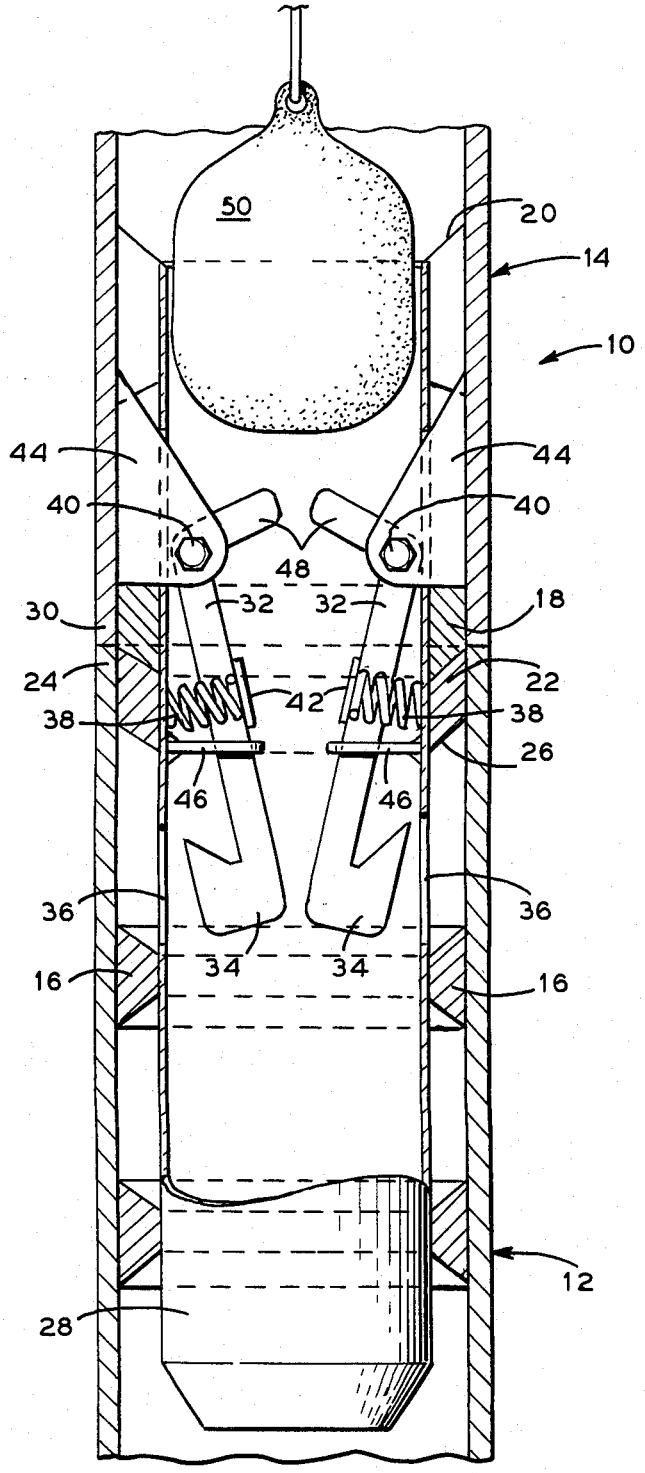
FIG. 2 is a pictorial sectional view, partially broken away, of the invention illustrating the skirt pile and the follower pile in the unlatched position.
Figure 3:
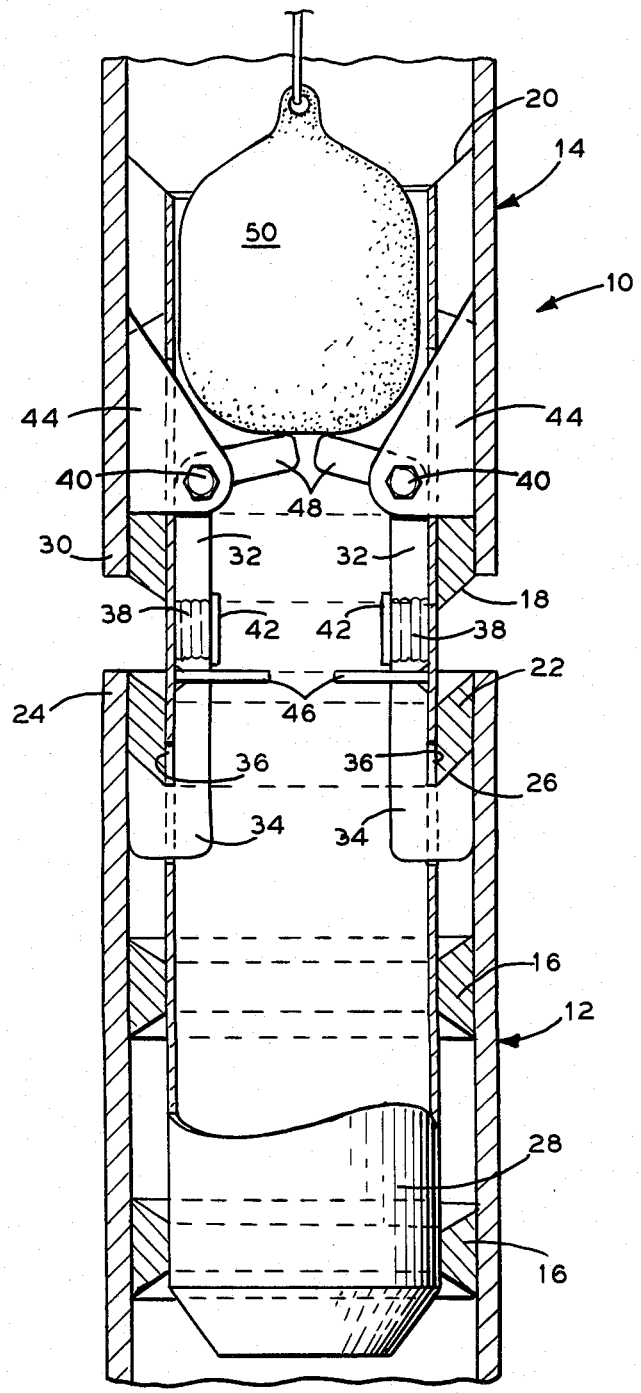
FIG. 3 is a pictorial sectional view, partially broken away, of the invention in the latched position.

Referring initially to FIGS. 1 thru 3, there is shown lowering and coupling assembly or daigle dog 10 which includes skirt pile 12 and follower pile 14. Both skirt and follower piles 12 and 14 are generally tubular in shape and may have a diameter of 72" although different diameters are equally feasible. Skirt pile 12 includes a plurality of annular spacers 16 therein concentrically secured to its interior surface and follower pile 14 includes lower annular shim plate 18 and upper shim plates 20 secured to its interior surface. Upper shim plates 20 are spaced approximately every 2 feet about the inside circumference of follower pile 14. Additionally, annular catch 22 is secured to end region 24 of skirt pile 12, and its lower surface 26 slopes downward toward the center axis of skirt pile 12.

Cylindrical stabbing guide 28 is rigidly secured to shim plates 18 and 20 of follower pile 14 and stabbing guide 28 projects outward beyond end region 30 of follower pile 14. Stabbing guide 28 is sized to slidably fit within annular spacers 16 of skirt pile 12 with little or no play between them. When inserted, stabbing guide 28 concentrically aligns follower pile 14 with skirt pile 12 enabling end region 30 of follower pile 14 to abut end region 24 of skirt pile 12. Thus as follower pile 14 is hammered upon, this force is directly transmitted to skirt pile 12 and these piles 12 and 14 remain aligned during such force transmittal due to stabbing guide 28. Stabbing guide 28 may have a diameter of 60" although other sized diameters are equally feasible and stabbing guide 28 is rigidly secured to follower pile 14 such as by welding.

Figure 4:
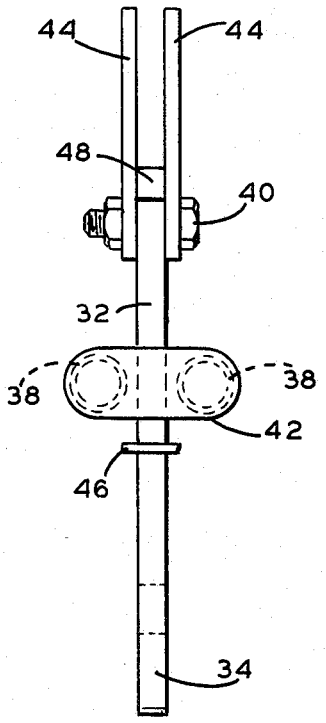
FIG. 4 is a pictorial view, partially broken away, of the latching arm and its pivotal support, taken along lines 4—4 of FIG. 1.

As shown in the figures, a pair of latching arms 32 are pivotally secured to follower pile 14 interior of stabbing guide 28. It should be noted, however, that in some circumstances and under some loading conditions, a single latching arm may be suitable or several such arms may be required. Latching end region 34 of arms 32 extend through openings 36 in stabbing guide 28 and these regions 34 are configured to engage and latch with annular catch 22 of skirt pile 12. Arms 32 are biased by springs 38 such that latching end regions 34 are normally biased toward the center of stabbing guide 28 and away from catch 22. Springs 38 are generally positioned on each side of arm 32 intermediate pivot pin 40 and latching end regin 34, and springs 38 bias between stabbing guide 28 and coil spring pods 42 (FIG. 4) secured to each latching arm 32. Pivot pin 40 extends through a pair of padeyes 44 on either side of latching arm 32 although a single or multiple padeyes may be required in some circumstances and these padeyes 44 are often welded or otherwise rigidly secured to the interior surface of follower pile 14. A stop 46 is secured adjacent each latching arm 32 to restrict their movement by springs 38 within stabbing guide 28.

End region 48 of each latching arm 32 is bent at approximately a 90° angle to partially extend inward toward the center of follower pile 14. These bent end regions 48 are subsequently engaged by weight 50 which moves interior of follower pile 14. Once engaged, the pivotal force of weight 50 about pin 40 overcomes the opposing bias of springs 38 and pivots end region 34 of each latching arm 32 through openings 36 in stabbing guide 28 to engage and latch with annular catch 22 of skirt pile 12. When weight 50 is removed from engagement with bent end region 48 of each latching arm 32, coil springs 38 bias latching arms 32 to their normal position away from annular catch 22 and toward the center of stabbing guide 28. Stop 46 secured to stabbing guide 28 restricts the inward movement of latching arms 30 due to spring 38.

During operation, latching arms 32 would normally be pivoted by spring 38 to rest against stop 46 and latching end region 34 would not extend through openings 36 in stabbing guide 28. Follower pile 14 and skirt pile 12 would then be moved together to insert stabbing guide 28 within skirt pile 12 thereby aligning follower pile 14 and skirt pile 12. After end regions 24 and 30 of skirt and follower piles 12 and 14 respectively engage, weight 50 is moved through follower pile 14, generally via gravity, until coming to rest against bent end regions of latching arms 32. Weight 50 is typically sized so as to overcome the bias of coil springs 38 plus an additional 10 percent or so. Weight 50 pivots latching arms 32 about pivot pin 40 causing latching end regions 34 to extend through openings 36 in stabbing guide 28 thereby engaging lower surface 26 of annular latch 22 secured to skirt pile 12.

Generally, there is some longitudinal play between a first position where latching end region 34 engages annular catch 22 and a second position where end regions 24 and 30 are in contact with each other. Thus longitudinal play assists in the driving of skirt pile 12 and in coupling skirt pile 12 and follower pile 14 together. After the coupling of skirt and followers piles 12 and 14, they are lowered to the sea bed and skirt pile 12 is manuvered into position prior to it being driven by a hammer (not shown) secured to the free end of follower pile 14. Once skirt pile 12 is driven and it is desirable to remove follower pile 14, weight 50 is moved from engagement with bent end region 48 of latching arms 32 thereby enabling springs 38 to bias latching arms 32 away from catch 22. At this time, end regions 24 and 30 may or may not be in contact with each other in order to enable latching end region 34 to disengage itself from sloped lower surface 26 of catch 22. Once disengaged, follower pile 14 and lowering and coupling assembly 10 can be removed from skirt pile and retrieved from the sea depths.

Obviously, for operation, skirt pile 12 may be resting on the ocean floor with follower pile 14 lowered to engage skirt pile 12 or both skirt and follower piles 12 and 14 may be coupled above the water surface and lowered together.

Many modifications may be made to this invention without departing from the basic spirit of it. Accordingly, the invention may be practiced other than as specifically disclosed herein.

Figure 5:
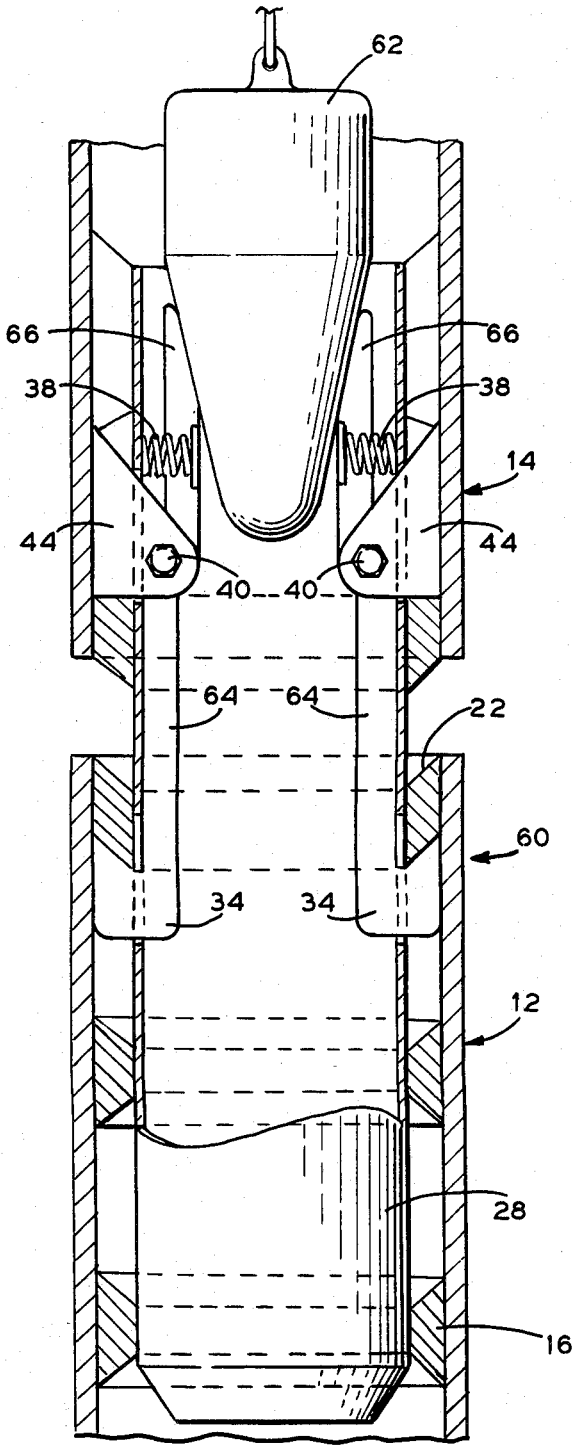
FIG. 5 is a pictorial view, partially broken away, of an alternate configuration of the latching assembly.

Referring now to FIG. 5, there is shown alternate lowering and coupling assembly 60 which contains many of the same components as assembly 10 but alternate assembly 60 is configured as a "weight release" assembly whereas assembly 10 is configured as a "weight lock" assembly. In contrast to assembly 10, assembly 60 relies upon the removal or release of weight 62 from engagement with latching arms 64 for latching to occur. In this embodiment, latching arms 64 are biased by springs 38 but these springs are secured on follower pile 14 side of pivot pin 40 thereby pivoting latching end region 34 into engagement with catch 22. As weight 62 engages end region 66 of latching arms 64, it overcomes the bias of springs 38 and pivots latching end region 34 inward or away from catch 22 thereby enabling follower pile 14 to become disengaged from skirt pile 12.

To couple follower pile 14 with skirt pile 12, weight 62 would engage latching arms 64 to pivot their latching end region 34 inward so as to pivot these end regions enabling them to be inserted within skirt pile 12. Once inserted, weight 62 is lifted and springs 38, no longer being compressed, would then expand pivoting latching end regions 34 into engagement with catch 22.

What is claimed is:

1. A pile lowering and coupling assembly comprising:

a skirt pile having an upper region and a catch secured to said skirt pile in said upper region;

a follower pile sized to engage said upper region of said skirt pile;

a stabbing guide secured to said follower pile for concentrically aligning said skirt and said follower piles;

at least one latching arm pivotally secured to said follower pile having a latching end region configured to latch with said catch of said skirt pile;

first bias means for pivoting said latching end region in a first direction away from said catch;

second bias means for pivoting said latching end region in a second direction toward said catch; and, operating means for selectively pivoting said latching end region whereby when said first bias means overcomes the bias of said second bias means, said latching end region is moved in said first direction and, when said second bias means overcomes the bias of said first bias means, said latching end region is moved in said second direction.

2. A pile lowering and coupling assembly as set forth in claim 1 wherein said skirt pile and said follower pile are tubular, said catch is annular, and said stabbing guide is sized to fit within said skirt pile.

3. A pile lowering and coupling assembly as set forth in claim 1 wherein there are a pair of oppositely spaced latching arms.

4. A pile lowering and coupling assembly as set forth in claim 2 wherein said latching arm is pivotally secured interior of said follower pile and wherein said stabbing guide has at least one opening therein through which said latching end region of said latching arm extends when said latching with said catch.

5. A pile lowering and coupling assembly as set forth in claim 4 wherein one said bias means comprises a spring.

6. A pile lowering and coupling assembly as set forth in claim 5 wherein the other said bias means comprises a moveable weight suspended within said follower pile and sized to overcome the bias of said spring.

7. A pile lowering and coupling assembly as set forth in claim 5 further comprising a stop configured to restrict the movement of said latching arm.

8. A pile lowering and coupling assembly as set forth in claim 6 wherein said latching arm is configured having an end region opposite to said latching end region and configured to engage said weight.

* * * * *